United States Patent [19]

Troncoso, Jr. et al.

[11] Patent Number: 4,565,377

[45] Date of Patent: Jan. 21, 1986

[54] HUNTING ARROW AND BROADHEAD

[76] Inventors: Fernando V. Troncoso, Jr.; Vincent F. Troncoso, both of 14090-6100 Rd., Montrose, Colo. 81401

[21] Appl. No.: 676,268

[22] Filed: Nov. 29, 1984

[51] Int. Cl.[4] ..... F41B 5/02

[52] U.S. Cl. ..... 273/422; 273/423

[58] Field of Search ..... 273/416, 419–423; 244/3.23

[56] References Cited

U.S. PATENT DOCUMENTS

| | | | |
|---|---|---|---|
| 31,099 | 1/1861 | Abbot | 244/3.23 |
| 33,378 | 10/1861 | Shell | 244/3.23 |
| 671,877 | 4/1901 | Cole | 244/3.23 |
| 2,212,345 | 8/1940 | Krieger | 273/420 |
| 3,751,037 | 8/1973 | Courneya | 273/423 |
| 4,036,499 | 7/1977 | Sherwin | 273/422 |
| 4,146,226 | 3/1979 | Sorensen | 273/422 |
| 4,210,330 | 7/1980 | Kosbab | 273/422 |

FOREIGN PATENT DOCUMENTS

| | | | |
|---|---|---|---|
| 24432 | of 1903 | United Kingdom | 244/3.23 |

*Primary Examiner*—Paul E. Shapiro
*Attorney, Agent, or Firm*—Donald E. Nist

[57] ABSTRACT

The arrow includes an elongated shaft having spaced rear stabilizing vanes extending generally longitudinally and diagonally, and a broadhead detachably connected to the front of the shaft. The broadhead has an elongated central core with slots receiving spaced sharp blades held in place at their front tips by a point releasably screwed to the front end of the core and at their rear ends by a ring which fits over notched blade portions. The broadhead includes spaced front stabilizing vanes extending generally longitudinally and diagonally in the same direction as the rear vanes to greatly increase arrow spin, speed, shooting accuracy and killing power. The front vanes may be all of each of the blades themselves or their bent rear portions or may be separate vanes disposed in a fitting at the rear of the core. The point can have chiseled diagonal outer recesses for better bone penetration. The broadhead and arrow are inexpensive, durable and efficient.

12 Claims, 5 Drawing Figures

HUNTING ARROW AND BROADHEAD

BACKGROUND OF THE INVENTION

1. Field of the Invention

The present invention generally relates to archery and more particularly to an improved hunting arrow and broadhead for the arrow.

2. Prior Art

Most archery hunting arrows are relatively large and heavy, with a large part of the weight due to heavy, large and sharp cutting broadheads connected thereto. The flight stabilization of such arrows is a problem because of the broadhead. Straight rear fletching, that is, fletching applied to the rear of the shaft and aligned along the longitudinal axis of the shaft or parallel thereto does not impart enough spin stabilization to the arrow to allow it to be shot with any reasonable degree of accuracy. Accordingly, so-called diagonal, spiral or helical rear fletching has been used to increase arrow spin and accuracy. However, since the boradhead itself usually consists of three or four very large blades extending radially outwardly from the broadhead core along the longitudinal axis of the core and shaft, the broadhead blades seriously impede rotation of the arrow and in fact cause it to wobble and deflect off-line. Even in those cases where the wobble and deflection are somewhat reproducible, gross sight adjustments must be made. The arrow must be shot repeatedly in order to permit the archer some insight concerning how to make sight corrections at various distances for defective arrow flight trajectories. Accordingly, there is a need for a hunting arrow and broadhead which will have improved flight characteristics, will spin more rapidly and will not deflect off course.

It is also important to be sble to transmit as much force as possible to the animal being shot by the arrow and to have the arrow cause as much bone and tissue destruction and as much bleeding as possible, in order to improve the number of kills. Arrows which wobble and spin slowly dissipate needed energy and are not efficient energy transmitters. Moreover, the broadhead blades usually do not cause massive tissue destruction and bleeding. The broadhead points themselves also are not ideally adapted for bone penetration. Accordingly, there is a need for a hunting arrow and broadhead which will exhibit improved killing power, tissue and bone destruction and bleeding.

A further problem encountered with the use of broadheads is assembling the broadheads and changing the blades when they break. Conventional broadheads that lock down from front to rear are extremely difficult and hazardous to assemble. It is difficult to align and hold all blades in place while attempting to lock them down simultaneously. Accordingly, there is a need for a hunting arrow and broadhead which will be easier, quicker and safer to assemble than conventional arrows and broadheads.

SUMMARY OF THE INVENTION

The improved hunting arrow and broadhead of the present invention satisfy all the foregoing needs. The arrow and broadhead are substantially as set forth in the Abstract above. Thus, the arrow includes a shaft with rear fletching disposed diagonally to the main shaft axis, and a broadhead releasably connected to the front of the shaft. The broadhead includes an elongated core with spaced slots retaining the bases of blades projecting peripheral of the core. The blades of the broadhead anchor at the rear portion of the core and are held in place by a sliding retainer ring. The front tips of the blades are then locked in place under the arrow point which is screwed to the core. The rear end of the core is screwed to the shaft, enabling easy removal and exchange of blades without needing to remove the core from the arrow shaft.

The broadhead includes a plurality of spaced front stabilizing vanes which are disposed diagonally in the same direction as the rear fletching. This results in rapid spinning of the arrow during shooting, faster and more accurate flight and increased energy transfer to the hit animal, with greater tissue and bone destruction, bleeding and killing. The front stabilizing vanes may be the entire blades themselves, or bent rear ends thereof, or separate vanes disposed in a preferably reversible fitting at the rear of the core.

The core itself may also be reversible. The arrow point may include chiseled, outer recesses diagonalized to match the front vanes and to increase bone penetration. Other features of the invention are set forth in the following detailed description and accompanying drawings.

DRAWINGS

DETAILED DESCRIPTION

FIGS. 1–2

Figure 1:
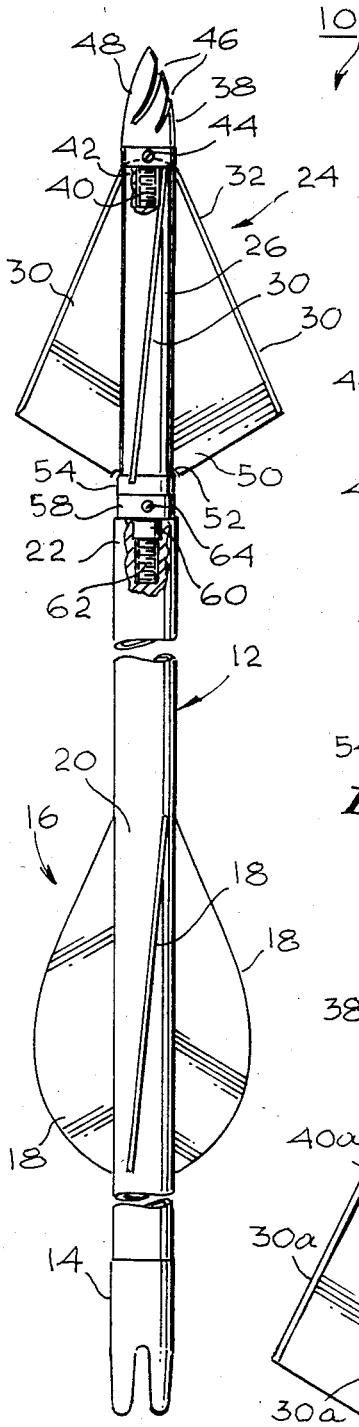
FIG. 1 is a schematic, fragmentary top plan view, partly broken away, of a first preferred embodiment of the improved hunting arrow and broadhead of the present invention.
Figure 2:
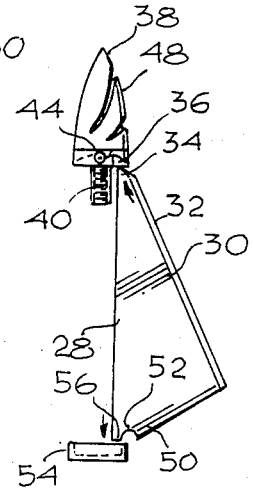
FIG. 2 is a schematic, top plan view, partly broken away, of a blade, and the point and retaining ring of the broadhead of FIG. 1.

Now referring more particularly to FIG. 1 of the accompanying drawings, a first preferred embodiment of the improved hunting arrow and broadhead of the present invention is schematically depicted therein. Thus, arrow 10 is shown, which comprises an elongated cylindrical shaft 12 of aluminum, wood, steel, plastic, carbon, graphite or the like having a rear string nock 14 and rear stabilizing fletching 16 in the form of a plurality of spaced vanes 18 of plastic, feather, foil or the like. Vanes 18 are connected to and spaced around the outer surface 20 of shaft 12, and extend peripherally and generally longitudinally thereof, but are slanted diagonal to the longitudinal axis of shaft 12 to increase spinning and stabilization of arrow 10 when it is shot from a bow.

To the front end 22 of shaft 12 is releasably secured a broadhead 24 of steel or the like which comprises an elongated preferably cylindrical core 26 having a plurality of elongated slots (not shown) disposed diagonally in the same direction as rear vanes 18 and in which the bases 28 of four sharp, thin, generally triangular blades 30 are releasably secured. Blades 30 have sharpened edges 32 and extend peripherally outwardly from core 26 generally longitudinally of core 26 and diagonal to shaft 12 in the same direction as vanes 18, and act as stabilizing front vanes for arrow 10. This orientation of blades 30 substantially increases the spin of arrow 10 in flight, its shooting accuracy, speed, smoothness of flight, hitting and shocking power and the extent of penetration, tissue and bone destruction and bleeding in the hit animal, thereby improving the kill percentage. Since arrow 10 spins more rapidly with blades 30 diagonaled as shown, a roundish large hole is drilled into the animal to greatly increase bleeding and death.

Blades 30 are releasably secured in place in broadhead 24 by having their front tips 34 releasably secured in a rear recess 36 in generally conical arrow point 38. Point 38 has a rear screw 40 threadably secured in front end 42 of core 26. A radial hole 44 may extend into point 38 and receive a turn rod (not shown) to facilitate screwing and unscrewing point 38. Point 38 preferably has chiseled, elongated recesses 46 sloping diagonally in the outer surface 48 thereof in the same direction as blades 30 and vanes 18 to improve bone penetration.

The rear ends 50 of blades 30 each have a notch 52 to receive a rear retaining ring 54 with portion 56 of each blade trapped between ring 54 and the adjacent surface of core 26. Thus, a single ring 54 releasably holds all blades 30 snugly in place while point 38 performs the same function. With this arrangement, blades 30 are easy to secure to and remove from core 26. With point 38 partly unscrewed portions 56 can easily be fitted in ring 54 and bases 28 in the appropriate slots. Tightening of point 38 locks tips 34 and the whole of blades 30 firmly in place in broadhead 24.

Broadhead 24 includes a rear fitting 58 upon which ring 54 rests. Fitting 58 has a base 60 which fits into end 22 of shaft 12 and bears a screw 62 threadably received in end 22. Fitting 58 may have a radial hole 64 through which a key can be used easily to screw and unscrew broadhead 24.

Thus, arrow 10 and broadhead 24 are simple, durable, efficient and easy to assemble and disassemble. The diagonal vanes 18, blades 30 and recesses 46 facilitate fast spinning of arrow 10 in flight with the improved flight characteristics, accuracy and killing power previously described. In addition, the slope of blades 30 at the front end of core 26 allows greater clearance between the blade slots and screw 40, permitting core 26 to be made smaller and lighter than conventional broadhead cores, thus increasing arrow speed.

FIG. 3

Figure 3:
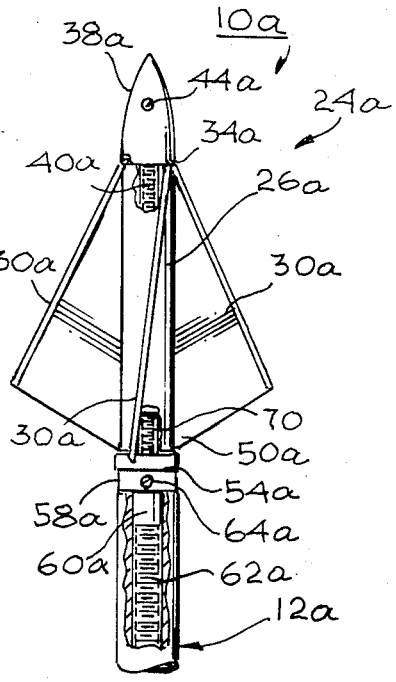
FIG. 3 is a schematic, fragmentary top plan view, partly broken away, of a second preferred embodiment of the improved broadhead and arrow of the present invention.

A second preferred embodiment of the improved broadhead and arrow of the invention is schematically depicted in FIG. 3. Thus, arrow **10*a* is shown. Components thereof similar to those of arrow 10 bear the same numerals but are succeeded by the letter "a". Arrow 10*a* includes shaft 12*a* with fletching (not shown) diagonaled in the same direction as fletching 16**.

Broadhead **24*a* is identical to broadhead 24 except that point 38*a* has no chiseled outer recesses and has its turn hole 44*a* high up in point 38*a*. Core 26*a* has blades 30*a* attached thereto in the manner previously described, with tips 34*a* trapped under point 38*a* and rear ends 50*a* held by ring 54*a***.

Core **26*a* is reversible. In this regard, fitting 58*a* includes a screw 70 releasably threadably received in core 26*a*, as shown in FIG. 3. Fitting 58*a* includes screw 62*a* releasably threadably received in shaft 12*a*. Point 38*a* can be removed and core 26*a* unscrewed from fitting 58*a*, then turned end for end, after which it can be rescrewed to fitting 58*a* and point 38*a*** later replaced.

FIG. 4

Figure 4:
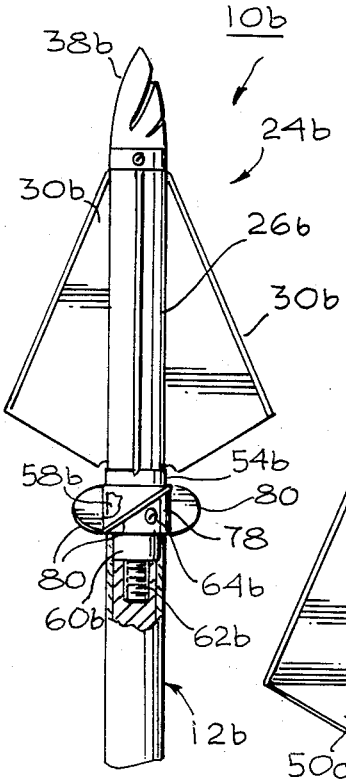
FIG. 4 is a schematic fragmentary top plan view, partly broken away, of a third preferred embodiment of the improved broadhead and arrow of the present invention; and, FIG. 5 is a schematic, fragmentary top plan view, partly broken away, of a fourth preferred embodiment of the improved broadhead and arrow of the present invention.

A third preferred embodiment is schematically shown in FIG. 4. Thus, arrow **10*b* is shown. Components thereof similar to those of arrow 10 or 10*a* bear the same numerals but are succeeded by the letter "b". Arrow 10*b* includes shaft 12*b* bearing rear fletching (not shown) identical to and diagonaled in the same direction as vanes 18. However, in broadhead 24*b*, core 26*b* has vanes 30*b* attached thereto in an orientation along the longitudinal axis of shaft 12*b*. Blades 30*b* are held in place by point 38*b* and ring 54*b*. In this instance, fitting 58*b* is elongated and has an outer ring 78 seated thereover. Ring 78 bears vanes 80 which are diagonaled in the same direction as the rear fletching (see FIGS. 1 and 4). These front vanes 80 impart the desired improved spin stabilization to arrow 10*b*. Hole 64*b* extends through both ring 78 and fitting 58*b*. Accordingly, arrow 10*b* has substantially the advantages of arrows 10 and 10*a***.

FIG. 5

Figure 5:
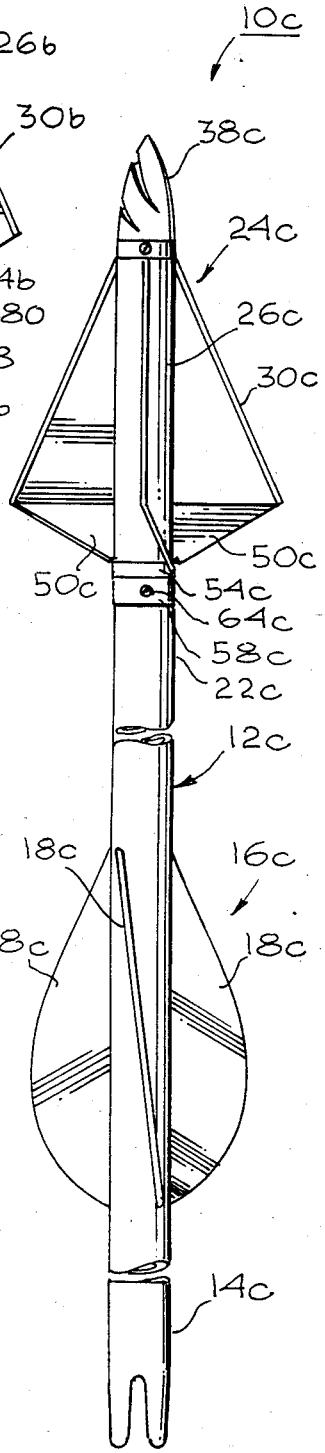

A fourth preferred embodiment of the invention is schematically depicted in FIG. 5. Thus, arrow **10*c* is shown. Components thereof similar to those of arrow 10, 10*a* or 10*b* bear the same numerals but are succeeded by the letter "c". Arrow 10*c* includes shaft 12*c* with nock 14*c* and fletching 16*c*, the latter comprising vanes 18*c* angled along a diagonal opposite to that of vanes 18. Broadhead 24*c* includes core 26*c* bearing blades 30*c* which are aligned along the longitudinal axis of core 26*c* and shaft 12*c* but which include rear portions 50*c* bent at an angle to follow the diagonal direction of vanes 18*c* and thus provide the required front vane spin stabilization. Point 38*c*, ring 54*c* and fitting 58*c* are releasably connectable to core 26*c* and complete the array. Fitting 58*c* releasably connects broadhead 24*c* to shaft 22*c***.

Various other modifications, changes, alterations and additions can be made in the improved arrow and broadhead of the present invention and in their components. All such modifications, changes, alterations and additions as are within the scope of the appended claims form part of the present invention.

What is claimed is:

1. An improved hunting arrow, said arrow comprising, in combination:

a. an elongated arrow shaft;

b. stabilizing arrow fletching connected to the rear end of the shaft, said fletching comprising a plurality of spaced rear stabilizing vanes extending generally longitudinally and peripheral of said shaft, said rear vanes being disposed diagonally in a selected direction relative to the longitudinal axis of said shaft; and, c. a broadhead connected to the front of said shaft, said broadhead comprising a longitudinally extending central core, a plurality of spaced sharp blades the bases of which are releasably received in slots in said core and which extend peripherally thereof, a point releasably screwed to the front end of said core and defining a blade front tip-receiving rear space, the front tips of said blades being releasably held in said rear space by said point, said core having a rear ring slideably received thereover, the rear end of each said blade having a ring-receiving notch, a portion of said blade rear end being releasably seated within said ring, the rear of said core terminating in a fitting secured thereto and having an annular shoulder against which said ring rests and which limits the rearward movement of said ring relative to said core, said fitting being releasably screwed to the front of said shaft, and a plurality of spaced front stabilizing vanes connected to said core, extending generally longitudinally and peripherally thereof and disposed diagonally in the same direction as said rear stabilizing vanes to increase rotation and accuracy of said arrow.

2. The improved arrow of claim 1 wherein said blades comprise said front stabilizing vanes.

3. The improved arrow of claim 1 wherein the rear portion of each of said blades is bent to angle diagonally and form said front stabilizing vanes.

4. The improved arrow of claim 1 wherein said broadhead includes a separate rear fitting containing said front stabilizing vanes.

5. An improved broadhead for a hunting arrow, said broadhead comprising, in combination:

a. a longitudinally extending central core containing a plurality of spaced slots;

b. a plurality of spaced sharp blades releasably disposed in said slots and extending peripherally thereof, the rear end of each said blade having a ring-receiving notch;

c. a point releasably secured to the front end of said core and defining a blade front tip-receiving rear space, the front tips of said blades being releasably held in said rear space by said point;

d. a rear ring slideably received over said core and resting against a rear fitting which is secured to said core and contains an annular shoulder limiting rearward movement of said ring, said ring being disposed within said notches to releasably seat said blades; and, e. a plurality of spaced front stabilizing vanes connected to said core, extending longitudinally and peripherally thereof and disposed diagonally relative to the longitudinal axis of said core.

6. The improved broadhead of claim 5 wherein the front tip of each of said blades fits under and is releasably held by said point.

7. The improved broadhead of claim 6 wherein said point is releasably screwed to said core and defines a blade tip-receiving rear space, wherein the rear of said core is releasably screwed to the front of said shaft, and wherein said blades are flat, bear a razor edge and have a rear ring-receiving notch.

8. The improved broadhead of claim 6 wherein said blades comprise said front stabilizing vanes.

9. The improved broadhead of claim 6 wherein the rear portion of each of said blades is bent to angle diagonally and form said front stabilizing vanes.

10. The improved broadhead of claim 6 wherein said broadhead includes a rear fitting containing said front stabilizing vanes.

11. The improved broadhead of claim 6 wherein said point includes elongated outer recesses which extend generally longitudinally and diagonally in the same direction as said vanes.

12. The improved broadhead of claim 6 wherein said core is reversible end to end and wherein said broadhead includes a rear fitting disposed between and screwed to said core and said shaft.

* * * * *